US006094840A

United States Patent [19]

Wanger

[11] Patent Number: 6,094,840

[45] Date of Patent: Aug. 1, 2000

[54] METHOD FOR THE HEAT TREATMENT OF TEXTILES

[75] Inventor: Freddy Wanger, Oberrohrdorf, Switzerland

[73] Assignee: Xorella AG, Wettingen, Switzerland

[21] Appl. No.: 09/311,610

[22] Filed: May 13, 1999

Related U.S. Application Data

[63] Continuation of application No. PCT/IB97/01400, Nov. 6, 1997.

[51] Int. Cl.[7] ..... F26B 3/00

[52] U.S. Cl. ..... 34/448; 34/468; 34/469; 68/5 C; 8/149.3

[58] Field of Search ..... 34/402, 403, 404, 34/406, 409, 411, 412, 443, 444, 448, 449, 467, 468, 469; 57/308; 28/249, 285; 8/149.3; 68/5 C, 5 D, 5 E

[56] References Cited

U.S. PATENT DOCUMENTS

| | | | |
|---|---|---|---|
| 4,262,377 | 4/1981 | Sando et al. | 8/149.1 |
| 4,426,746 | 1/1984 | Sando et al. | 8/149.3 |
| 4,590,683 | 5/1986 | Magin | 34/402 |
| 4,702,014 | 10/1987 | Karrer | 34/404 |
| 5,484,453 | 1/1996 | Baehr et al. | 8/111 |
| 5,497,637 | 3/1996 | Fuller et al. | 68/4 |
| 5,512,062 | 4/1996 | Fuller et al. | 8/499 |

OTHER PUBLICATIONS

"Dampfen von Wollgarnen auf Spulen" Melliand Textilberichte V. 48, No. 10, Oct. 1967, pp. 1162–1164.

*Primary Examiner*—Pamela A. Wilson
*Attorney, Agent, or Firm*—Schweitzer Cornman Gross & Bondell LLP

[57] ABSTRACT

A method for the heat treatment of textiles, particularly advantageous for textiles wound on cops or bobbins, comprises applying a vacuum to a steamer chamber in which the textiles have been placed. When a sufficient vacuum has been reached a treatment liquid is introduced and the vacuum source shut off maintains the vacuums. The treatment liquid is then heated to generate a saturated steam treatment for the textiles. The liquid and steam are then pumped out of the chamber and a vacuum re-instituted for evacuation, cooling and drying, after which the chamber is returned to ambient. Subsequent cycles may be performed with other liquid treatments. An apparatus for carrying out the method may be in the form of a closed system in which the vessels from which the liquid treatment are drawn are coupled to the treatment chamber to allow return of the liquids when the liquids are pumped out. Liquid loss is thus minimized and efficiency increased.

8 Claims, 2 Drawing Sheets

METHOD FOR THE HEAT TREATMENT OF TEXTILES

The present invention relates to a method of heat-treating textiles, in particular spun cops or bobbins, in a heated steamer connected to a water and/or chemical supply and a vacuum pump via valves, and to an apparatus for carrying out the method. This application is a continuation of PCT/IB97/01400 filing date Nov. 6, 1997 whose disclosure is incorporated herein A by reference.

BACKGROUND OF THE INVENTION

As used herein, the term "textiles" means any structure made of raw textile materials and includes materials in both fibrous and sheet form. It is known that heat treatment has a favorable effect on various textiles, such as yarns, etc. for further processing. Textiles can also be conditioned or finished by treatment in a steam phase, if necessary with the addition of chemicals.

Suitable steamers have been known for many years and substantially comprise a cylindrical boiler closable by a pivotable cover. Inside the steamer is a water bath which generates steam by means of a heating device and effects the appropriate heat treatment of the material introduced. To enable the steam to better penetrate the interior of the textiles, a vacuum is generated before the heating device for the water bath is switched on. The vacuum is actively maintained as the heating device is switched on.

These known steamers have the disadvantage that large amount of energy are needed to form and maintain the vacuum. Furthermore, the steam is removed by the vacuum pump and has to be recondensed. This results in only limited steam penetration of the material to be treated and/or long treatment times.

An object of the invention is to provide a method and apparatus which use less energy, permit better penetration of the material to be treated and, in addition, reduce cycle times and overall heat treatment time.

BRIEF DESCRIPTION OF THE INVENTION

In accordance with such and other objects, the present invention provides a method of heat-treating textiles in a heated steamer connected to a water and/or chemical supply and a vacuum pump via valves, wherein, in a first step, the steamer is charged with the material to be treated.

In a second step, a vacuum pump is switched on until a vacuum of at least 100 mbar has been generated in the steamer. The pump is then shut off.

In a third step, a feed valve for water and/or a chemical supply is opened and a predetermined volume of liquid is admitted into the steamer to form a liquid bath.

In a fourth step, the liquid bath and the steam phase to be formed are heated to a pre-determined temperature. After the material to be treated has been held for a pre-selected time in the saturated steam phase the liquid is pumped out of the steamer into a container.

In a fifth step, the vacuum pump is re-activated.

In a sixth step, after a pre-selected evacuation, cooling and drying period, the vacuum pump is switched off and ambient air is admitted into the steamer.

In a final step, the material is removed from the steamer.

After the sixth step, the second through sixth steps can be re-performed for additional treatment phases or cycles.

For a liquid bath with a volume of 300 liters, the method according to the invention produces an energy saving in the order of 12 kwh per cycle or 35 to 40 kWh per treatment. Furthermore, the water vapor pumped off during the formation of the vacuum does not have to be recondensed. The non-recondensed volume saved is approximately 20 liters per treatment cycle.

The invention provides the further advantage that the amount of fresh water needed is also reduced by an order of magnitude on account of the re-circulation of the liquid. A further advantage consists in the simple and economic supply of chemicals and/or finishing additives which load the vacuum pump only slightly or not at all. The heat treatment and the results achieved may be further improved in a simple manner by repeating the second to sixth steps at least once.

The heat treatment can be optimized by successively increasing the temperatures of the steam phase from the first to at least one subsequent heat treatment. Preferably, during the heat treatment, a steam phase temperature of at least 350° K. is established in a first cycle and at least 380° K. in a further cycle. By increasing the holding time at a constant temperature during subsequent heat treatments the results may be improved without substantial increase in energy consumption.

Energy may additionally be saved by aeration and the overall treatment time further reduced as a result, i.e. before the end of the first heat treatment, in an intermediate step, the vacuum is interrupted and then built up again.

Preferably, the water and/or chemicals are supplied from containers dimensioned in accordance with the volume of the liquid bath in the steamer and which, together with the steamer, form a closed system into which only lost liquid is fed back from outside, the lost liquid being due to the residual moisture in the steamed material and the evacuation. Use of a closed system permits recirculation of the liquids and/or chemicals and is therefore particularly economical and environmentally friendly.

The invention further provides an apparatus for carrying out the above method, and comprises a heated steamer connected to a water and/or chemical supply and a vacuum pump via valves, wherein at least one container, a pump and at least two valves are provided for the liquid and/or chemical supply, the valves controlling the admission of liquid into and discharge of liquid from the steamer.

Preferably, an electric heating device is provided at least within the volume of a liquid bath within the steamer. Such an electric heating device is particularly advantageous because it can be controlled with great flexibility. Other heating systems, for example steam heating systems, may also be used economically depending on the energy available.

Preferably, the vacuum pump is a water-ring pump or a rotary vane pump. A water-ring pump is very cost-effective and suitable for vacuums up to 30 mbar. For vacuums up to 5 mbar, a rotary vane pump may be necessary.

BRIEF DESCRIPTION OF THE DRAWINGS

A preferred but nonetheless illustrative embodiment of the invention will now be described, by way of example only, with reference to accompanying drawings, wherein.

DETAILED DESCRIPTION OF THE INVENTION

Figure 1:
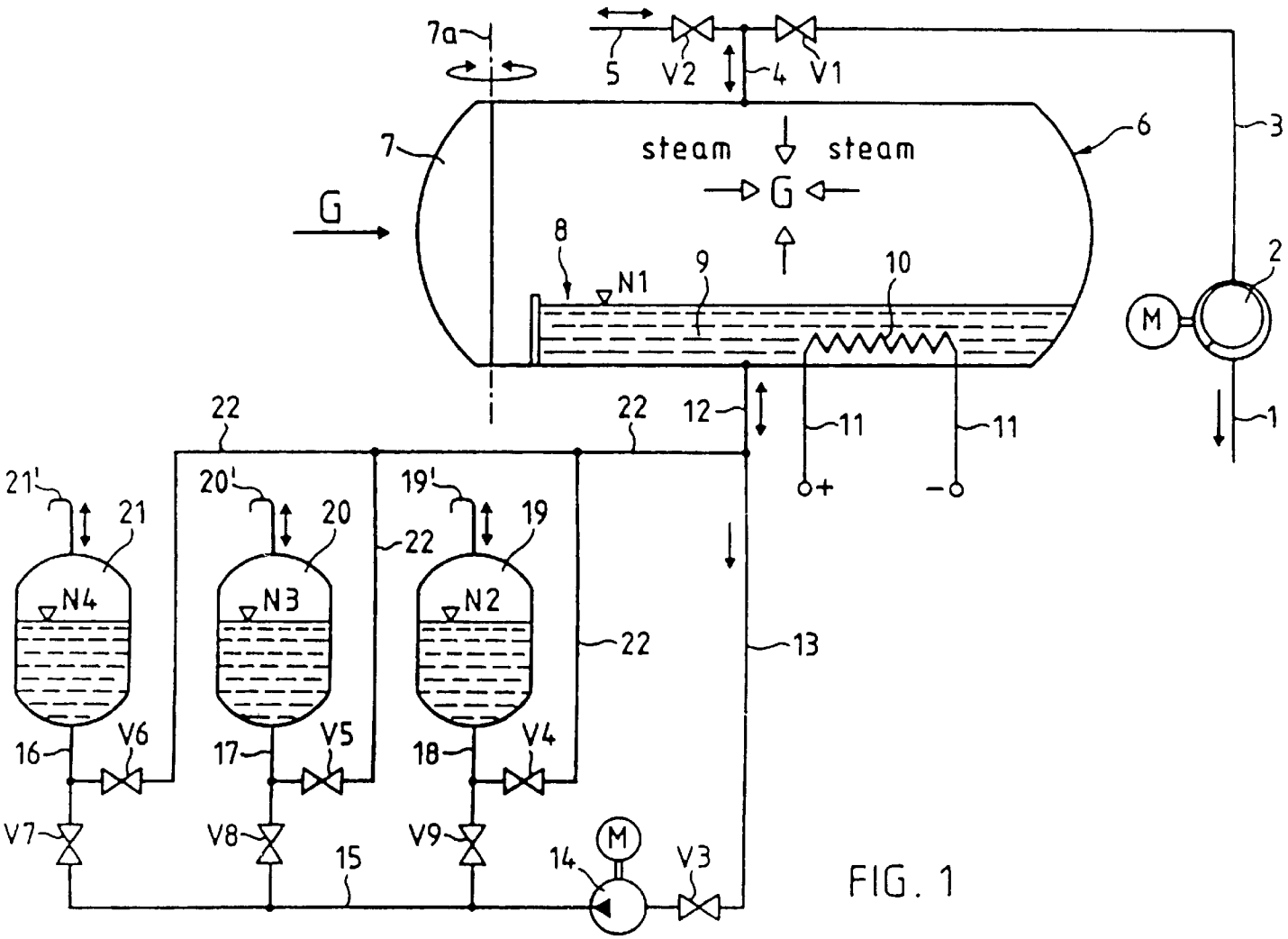
FIG. 1 is a simplified, schematic representation of a steam apparatus for treating cops in accordance with the invention.

In accordance with FIG. 1, an exhaust line is designated by the reference numeral 1. A vacuum pump 2 with an electric motor M is connected to the exhaust line 1. A vacuum line 3 is connected to the input side of the vacuum pump 2 (which may be a rotary vane pump) and communicates with the interior of a steamer 6 via a valve V1 and a suction line 4. A further valve V2 is also arranged in the suction line 4 and is connected to an air line 5.

A liquid bath 8, the aqueous liquid 9 of which can reach a level N1, and an electric heating device 10 are arranged inside the steamer 6 known per se. At one end, the steamer 6 is provided with a pivotable cover 7 having a vertical pivot axis 7*a*. The textile material G to be treated is introduced into the steamer 6 for steam-treatment by opening the cover 7. After the material is in place in the steamer the cover is closed.

Feed lines 11 lead from the electric heating device 10 to a control unit, the regulating function of which is represented by +/±. A liquid line 12 leads from the steamer 6 and is connected to pump line 13 and supply lines 22. The pump line 13 leads to parallel valves V7, V8, and V9 via a line valve V3, a liquid pump 14 with an electric motor M and pressure lines 15. The valves V7–V9 are for their part are each connected to the lower part of respective liquid containers 19–21 via inlet/outlet lines 16–18. Each of the liquid containers or tanks has an aeration line 19'–21', respectively. Valves V4–V6 couple the inlet/outlet lines 16–18 to the supply lines 22.

The operation of the arrangement according to FIG. 1 is relatively simple: the interior of the steamer 6 is evacuated to the desired low pressure via the vacuum lines 3 and 1 by closing the valve V2, opening the valve V1, and switching on the vacuum pump 2. As a result, the material G to be treated also becomes substantially free of entrapped air.

Valve V4 on the water tank 19 is then opened; valve V9 remains closed so that water is drawn via the supply line 22 and the liquid line 12 into the steamer, where it fills the liquid bath 8 to the level N1. The vacuum pump 2 is shut off and valve V7 closed. Valve V4 is closed and the electric heating device 10 is simultaneously activated by switching on the mains voltage, with the result that a steam phase forms inside the steamer 6 and penetrates the material G as saturated steam.

After a predetermined holding time, the control unit switches the heating device 10 off, and valves V3 and V9 are opened. Valve V4 remains closed and the liquid pump 14 is switched on. The water in the steamer is pumped back into the water tank 19 and returns to approximately the level N2. The resultant displaced air in the tank 19 can escape via the aeration line 19'.

Similarly, chemicals, such as acid or base treatments, can be fed from the chemical tank 20 into the steamer 6 and then pumped back again in subsequent treatment steps.

In addition, a liquid-wax tank 21 can be employed to dispense its contents after the last steaming process in order to facilitate further processing of the material G, particularly when it comprises spun yarn in the form of cops.

Figures 2, 3:
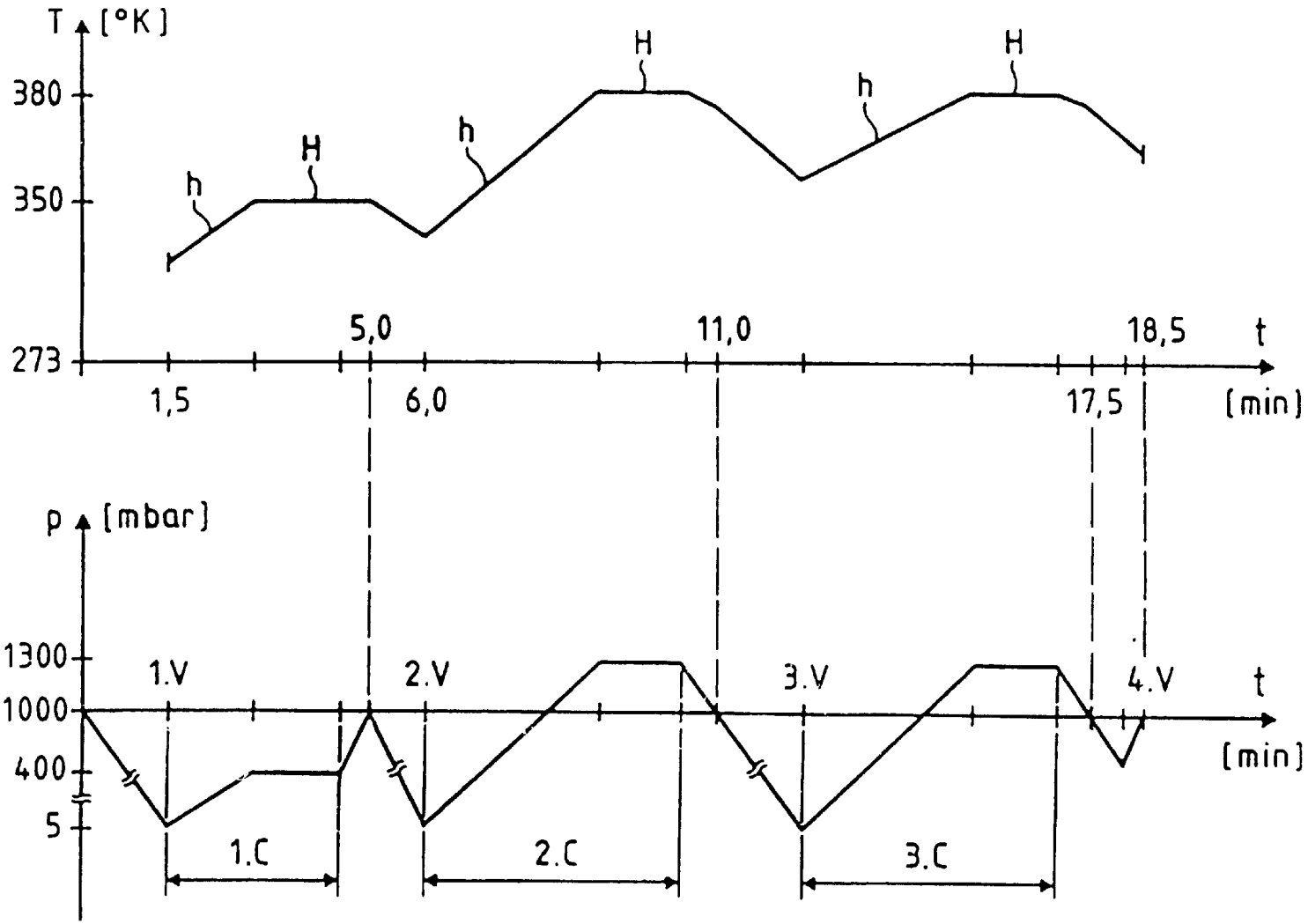
FIG. 2 is a characteristic temperature graph for the steam phase in the steamer of the installation according to FIG. 1.
FIG. 3 is a pressure graph associated with FIG. 2, in relation to the ambient atmosphere.

FIGS. 2 and 3 show the characteristics of a heat treatment for cops carried out in practice, starting from an ambient pressure of 1000 mbar. For graphical reasons, low pressures have been shown in abbreviated form in FIG. 3.

As shown in FIG. 3, the steamer 6 is evacuated to a pressure of 5 mbar, after which water from the water tank 19 is admitted at 1.V and heated, producing a steam phase having a temperature of approximately 350° K. held constant for 2.0 minutes; cf. FIG. 2. During this process, the pressure in the steamer 6 is raised to approximately 420 mbar.

The vacuum is then interrupted and a residual quantity of steam is released via the suction line 4 and the valve V2 into the air (aeration); cf. FIG. 1, returning the pressure to ambient.

As shown in FIG. 3, with the valve V2 closed, a vacuum of 5 mbar is subsequently regenerated and a second treatment cycle (2.C) begins. In this case, the temperature of the steam phase is increased to 380° K., the pressure being raised to a positive pressure of 1300 mbar during the heating of the liquid supplied from the chemical tank 20.

A similar procedure is performed for a third cycle (3.C), in which an aqueous wax solution from the liquid-wax tank 21 may be used to form the liquid bath 8.

Increasing the heating times and the holding times in the subsequent cycles in relation to the first cycle has proved highly advantageous with respect to optimizing the heat treatment.

The first cycle 1.C begins after the first evacuation process 1.V and lasts 3.0 minutes; the second and third cycles 2.C and 3.C each have a duration of 4.0 minutes. The complete heat treatment is finished after the fourth evacuation process 4.V, during which residual moisture is removed from the material. The material in question is a spun cotton yarn; the cops typically have a net weight of 120 g.

As can be seen from FIGS. 2 and 3, the complete heat treatment, including the application of wax to the yarn, lasts a total of only 18.5 minutes, despite the very large size of the cops.

Depending on the material to be treated and the processing required, for economic reasons it can be advantageous if a steam condenser is additionally connected upstream of the vacuum pump 2.

The process may also be carried out under vacuum with a pressure above 50 mbar. However, the process time may be increased and the quality of treatment may be reduced, especially when the material is heavy and/or compressed.

I claim:

1. A method of heat-treating a textile material in a heated steamer connected to at least one liquid supply and a vacuum pump via valves, wherein:

in a first step, the steamer is charged with the material to be treated;

in a second step, the vacuum pump is activated until a vacuum of at least 100 mbar absolute pressure has been generated in the steamer;

in a third step, a feed valve for a liquid supply is opened and a predetermined volume of liquid is admitted into the steamer to form a liquid bath;

in a fourth step, the liquid bath and a saturated steam phase to be formed therefrom are heated to a predetermined constant temperature, after the material to be treated has been held for a preselected time in the saturated steam phase, the liquid bath is pumped out of the steamer into the liquid supply;

in a fifth step, the vacuum pump is re-activated;

in a sixth step, after a preselected evacuation, cooling and drying time, the vacuum pump is deactivated and ambient air is admitted into the steamer; and in a final step, the material is removed from the steamer.

2. The method according to claim 1, wherein the vacuum generated in the second step is at least 50 mbar.

3. The method according to claim 1 or 2, wherein the second to sixth steps are repeated at least once.

4. The method according to claim 3, wherein the temperatures of the steam phases are increased from the first to at least one subsequent fourth step.

5. The method according to claim 4, wherein, a steam phase temperature of at least 350° K. is established in a first cycle and at least 380° K. in a further cycle.

6. The method according to claim 4, wherein the period of constant temperature during the first heat treatment is shorter than during a subsequent heat treatment.

7. The method according to claim 4, wherein before the end of a first heat treatment, in an intermediate step, the vacuum is interrupted and then built up again.

8. The method according to claim 1, wherein the liquids are supplied from containers dimensioned in accordance with the volume of the liquid bath in the steamer and which, together with the steamer, form a closed system into which only lost liquid is replenished, resulting from residual resistance in the steamed material and the evaluation step.

* * * * *